US005497827A

United States Patent [19]

Cornic

[11] Patent Number: 5,497,827

[45] Date of Patent: Mar. 12, 1996

[54] DEVICE FOR RADIALLY HOLDING THE BUNDLE ENVELOPE AND SPACER PLATES OF A STEAM GENERATOR BY ELASTICALLY POSITIONED ABUTMENTS

[75] Inventor: Gil Cornic, De Bruxelles, France

[73] Assignee: Framatome, Courbevoie, France

[21] Appl. No.: 322,516

[22] Filed: Oct. 14, 1994

[30] Foreign Application Priority Data

Oct. 14, 1993 [FR] France ..... 93 12217

[51] Int. Cl.[6] ..... F28F 9/00

[52] U.S. Cl. ..... 165/162; 122/510; 376/285

[58] Field of Search ..... 376/285, 402, 376/405; 165/81, 82, 160, 161, 162; 122/32, 34, 510, 512

[56] References Cited

U.S. PATENT DOCUMENTS

| | | | |
|---|---|---|---|
| 4,336,614 | 6/1982 | Mitchell et al. | 165/162 |
| 4,415,021 | 11/1983 | Bayless et al. | 165/162 |
| 4,503,903 | 3/1985 | Kramer | 165/162 |
| 4,583,584 | 4/1986 | Wepfer | 376/285 |
| 4,596,689 | 6/1986 | Gorholt et al. | 376/285 |
| 4,655,281 | 4/1987 | Neybourger et al. | 165/162 |
| 4,690,206 | 9/1987 | Bein | 376/285 |
| 4,768,582 | 9/1988 | Wepfer | 376/285 |

FOREIGN PATENT DOCUMENTS

| | | |
|---|---|---|
| 2511491 | 2/1983 | France . |
| 2562996 | 10/1985 | France . |

*Primary Examiner*—Daniel D. Wasil
*Attorney, Agent, or Firm*—Pollock, Vande Sande & Priddy

[57] ABSTRACT

A device for radially holding the envelope of a tube bundle and spacer plates of a steam generator, constituted by abutments traversing the wall of the bundle envelope and fixed to the wall level with the spacer plates. The said abutments being distributed on the periphery of each spacer plate in order to radially separate the bundle envelope from the pressure envelope of the steam generator. Each abutment comprises a first part (37) fixed to the bundle envelope (6) and contacted with the inner face of the pressure envelope (1), as well as a second part (32) exerting rigid holding stress on the spacer plate.

8 Claims, 4 Drawing Sheets

DEVICE FOR RADIALLY HOLDING THE BUNDLE ENVELOPE AND SPACER PLATES OF A STEAM GENERATOR BY ELASTICALLY POSITIONED ABUTMENTS

FIELD OF THE INVENTION

The present invention relates to a device for the radial holding or securing of the bundle envelope and spacer places of a steam generator.

BACKGROUND OF THE INVENTION

Heat exchangers such as the steam generators of a pressurized water nuclear reactor incorporate a tube bundle or nest constitituted by a very large number of small diameter tubes positioned vertically within a generally cylindrical bundle or nest envelope located within the external and very thick, rigid pressure envelope of the steam generator.

The pressurized water of the nuclear reactor flows within the small diameter tubes and the water to be vaporized is introduced into the bundle envelope, where it comes into contact with the outer surface of the tubes. The steam is recovered in the upper part of the bundle envelope and is then generally dewatered in steam-water separators located in the outer envelope of the steam generator above the bundle envelope.

Steam generators are very high units, in which the different coaxial envelopes are arranged with a generally small radial spacing.

It is known to use spacing plates into which pass the tubes of the bundle, and which are distributed in accordance with the bundle height, so as to keep the tubes in fixed, reciprocal radial positions. These spacer plates are interconnected by vertical tie rods, the assembly being placed within the bundle envelope.

It is therefore important to maintain the different coaxial envelopes of the steam generator and the assembly of the bundle by spacer plates in the radial directions, so as to avoid relative displacements and shocks between the the envelopes and the bundle in the case of external stresses, such as those accompanying an earthquake.

This radial maintaining or holding action is obtained by abutments fixed to the envelope of the bundle level with the spacer plates at a rate of several abutments for each spacer plate. These abutments are then regularly distributed on the periphery of the spacer plates.

Such a holding or securing device is known from FR-A-2,511,491. It is constituted by parts which are thicker than the bundle envelope and which have tapped holes within which it is possible to screw threaded studs, whose end projecting into the space between the bundle envelope and the rigid outer envelope bears against the inner surface of the outer envelope. The bearing action of these abutments is brought about after regulating the studs, by introducing wedge-shaped shims between the outer edge of the spacer plates and the inner surface of the bearing device directed towards the bundle.

Such abutments suffer from the disadvantage of occupying a considerable part of the width of the space reserved between the bundle envelope and the outer envelope and therefore significantly limiting the passage cross-section for the water to be vaporized flowing in the space and still without providing a perfect seal. These abutments also suffer from the disadvantage of requiring the introduction of shims into notches machined on the peripheral part of the spacer plates. These notches correspondingly decrease the distance between the peripheral tubes of the bundle and the edge of the spacer plates. If an adequate distance is to be maintained between the peripheral tubes and the plate, it is then necessary to reduce the number of tubes in the bundle. Moreover, abutments must have shapes which do not facilitate their fixing by welding in the bundle envelope wall.

Other devices for radially holding the bundle envelope and spacer plates of a steam generator are disclosed in FR-A-2,562,996 and U.S. Pat. Nos. 4,503,903, 4,583,584, 4,690,206 and 4,768,582. However, none of these devices are completely satisfactory. Their installation is generally complicated as a result of the use of shims for some of them. Certain of the devices do not offer an adequate bearing surface for holding the spacer plates.

SUMMARY OF THE INVENTION

In order to obviate these disadvantages, the present invention proposes a device permitting the radial holding of the bundle envelope and spacer plates of a steam generator and ensures ring simpler and faster installation than prior art devices. The inventive holding device also ensures better fixing of the spacer plates as a result of a larger bearing surface therewith. These advantages are in particular obtained by the use of elastically positioned abutments.

Thus, the invention relates to a device for the radial holding of the envelope of the tube bundle and the spacer plates of a steam generator, the steam generator comprising a pressure envelope extending along a given axis, the bundle envelope extending along the same axis and being contained in the pressure envelope so as to leave an annular space between the two envelopes, the spacer plates being located at given intervals and transversely to the said axis within the bundle envelope in order to support the tubes, the holding device being constituted by abutments traversing the bundle envelope wall and fixed to said wall level with the spacer plates. The abutments are distributed on the periphery of each spacer plate in order to radially separate the bundle envelope from the pressure envelope and so as to exert rigid holding stresses between the spacer plates and the bundle envelope. Each abutment has a first part fixed to the bundle envelope and incorporating means permitting their optional sliding on the inner face of the pressure envelope according to said axis and means for varying their radial dimension with respect to said axis, each abutment also having a second part with means for exerting said rigid holding stress on the spacer plate, fixing means being provided for immobilizing the second part with respect to the bundle envelope after contacting the second part and the spacer plate. The second part is connected to the first part by elastic means so as to make it movable relative to the first part in a radial direction relative to said axis between a first position corresponding to a first minimum radial dimension of the abutment and a second position corresponding to contact with the spacer plate.

Advantageously, the first part has a cavity housing the second part forming a piston in the cavity; this facilitates the installation operations with respect to the steam generator.

The elastic means can have a fluid blown into the cavity, in the space located between the first and second parts. This fluid can be blown in by a duct traversing the second part.

The elastic means can have a spring positioned between the first and second parts.

Preferably, the means permitting optional sliding of an abutment on the inner face of the pressure envelope and the means for varying the radial dimension are constituted by at least one screw screwed into the first part, the contact between said screw and the inner face of the pressure envelope taking place along a cambered end of the screw.

The invention also relates to a steam generator, whose radial holding or securing device for the envelope of the tube bundle and the spacer plates is made in the manner defined hereinafter.

BRIEF DESCRIPTION OF THE DRAWINGS

The invention will now be described in greater detail relative to and with reference to the attached drawings.

DETAILED DESCRIPTION

Figure 1:
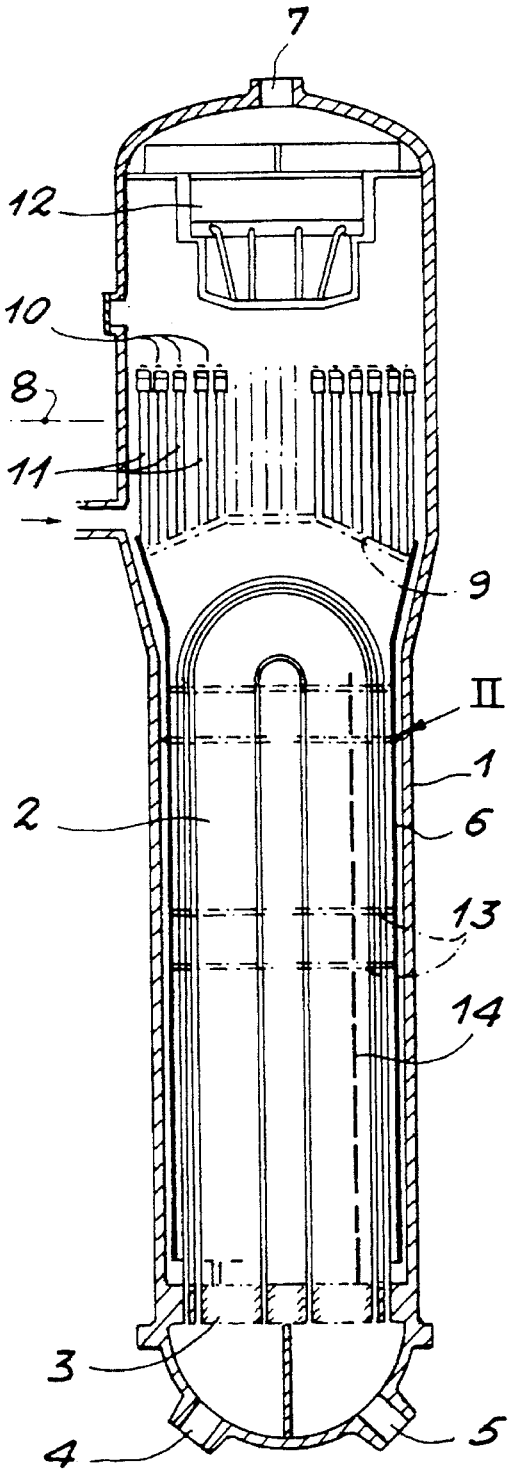
FIG. 1 PRIOR ART
FIG. 1 is a vertical sectional view of a steam generator used in pressurized water nuclear reactors.

The axial sectional view of FIG. 1 shows a steam generator with a pressure-resistant outer envelope 1, whose smaller diameter lower part contains a tube bundle or nest 2 consisting of an assembly of inverted U-shaped, bent tubes. These tubes are traversed by pressurized water forming part of the primary circuit and introduced into the steam generator below the tube sheet 3 by an inlet 4. The pressurized water passes through the tubes of the tube bundle 2 and then returns under the tube sheet 3 to pass out through the orifice 5.

Up to the vicinity of its lower part, the tube bundle 2 is surrounded by a bundle envelope 6 constituting the vaporization enclosure within which feed water in contact with the tube bundle 2, traversed by the high temperature water from the reactor core, progressively vaporizes on rising within the enclosure 6. The highest part of the steam dome is provided with an outlet 7 for the steam passing to the turbine.

A feed water supply device (not shown) makes it possible to maintain the feed water level 8 in the steam generator a certain distance above the tube bundle 2 and below cyclone separators 10 forming the first stage of the steam separator and communicating with the top of the vaporization enclosure 6 by means of tubular columns 11. These tubular columns are welded to the roof 9 of the vaporization enclosure 6 and provide the link with the interior of the enclosure. This feed water firstly passes into the space between the outer envelope 1 and the enclosure 6 to reach the lower end of the enclosure.

On passing out of the cyclone separators 10, the steam, which has given off most of the entrained water, passes into secondary separators 12 constituted by baffles permitting more complete drying of the steam prior to its exit through the orifice 7.

The tubes of the bundle are laterally held or secured by spacer plates 13 positioned transversely within the bundle envelope 6. Tie rods 14 fixed in their lower part to the tube sheet 3 make it possible to maintain the axial spacing of the spacer plates 13.

Figure 2:
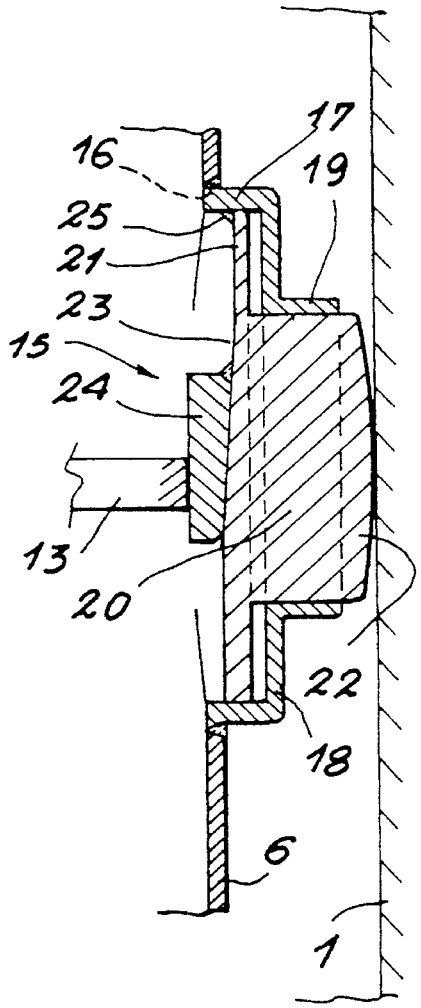
FIG. 2 PRIOR ART
FIG. 2 shows a known abutment for the radial holding of the bundle envelope and spacer plates of a steam generator.

FIG. 2 is a larger scale view of area II in FIG. 1. It shows one of the securing abutments for a spacer plate 13, which is fixed to the bundle envelope 6. To bring about this fixing, the envelope 6 has a radial opening 16 permitting the passage and fixing of a structure incorporating a radial sleeve 17 welded to the envelope 6 by one of its ends and projecting slightly into the annular space between the pressure envelope 1 and the bundle envelope 6. The structure also has an annular plate 18 welded to the end of the sleeve 17 located in the annular space and partly sealing said sleeve 17. The structure further has a second sleeve 19 placed in the alignment of the first sleeve 17 and welded to the edge of the hole of the annular plate 18.

The abutment comprises a generally cylindrical part 20, which is engaged in the structure described hereinbefore up to contact with the inner wall of the pressure envelope 1. The part 20 has a large diameter portion 21, whose diameter is very slightly less than the internal diameter of the sleeve 17, and a small diameter portion 22, whose diameter is very slightly smaller than the internal diameter of the sleeve 19. The face of the part 20 directed towards the interior of the bundle envelope 6 is machined so as to form a bearing surface 23 inclined by an angle close to 5° with respect to the vertical. The inclination angle of this bearing surface corresponds to the machining angle of the shims 24 interposed between the spacer plate 13 and the part 20.

The end of the portion 22 of the part 20 directed towards the pressure envelope is machined to form a spherical bearing surface on the pressure envelope.

In order to position the holding or securing abutments, the parts 20 are placed in their recesses and in contact with the pressure envelope 1. Each part 20 is then welded by a circular weld bead 25 to the inner face of the sleeve 17. A set of shims 24 is then placed and welded between the bearing surface 23 and the edge of the spacer plate 13 in order to bring about a rigid securing action between the spacer plates and the bundle envelope.

A description will now be given of two variants of the holding device according to the invention, which do not use shims as in the prior art device, and this will take place relative to FIGS. 3 to 5. It is possible to see therein the pressure envelope 1, the bundle envelope 6 and a spacer plate 13.

Figure 3:
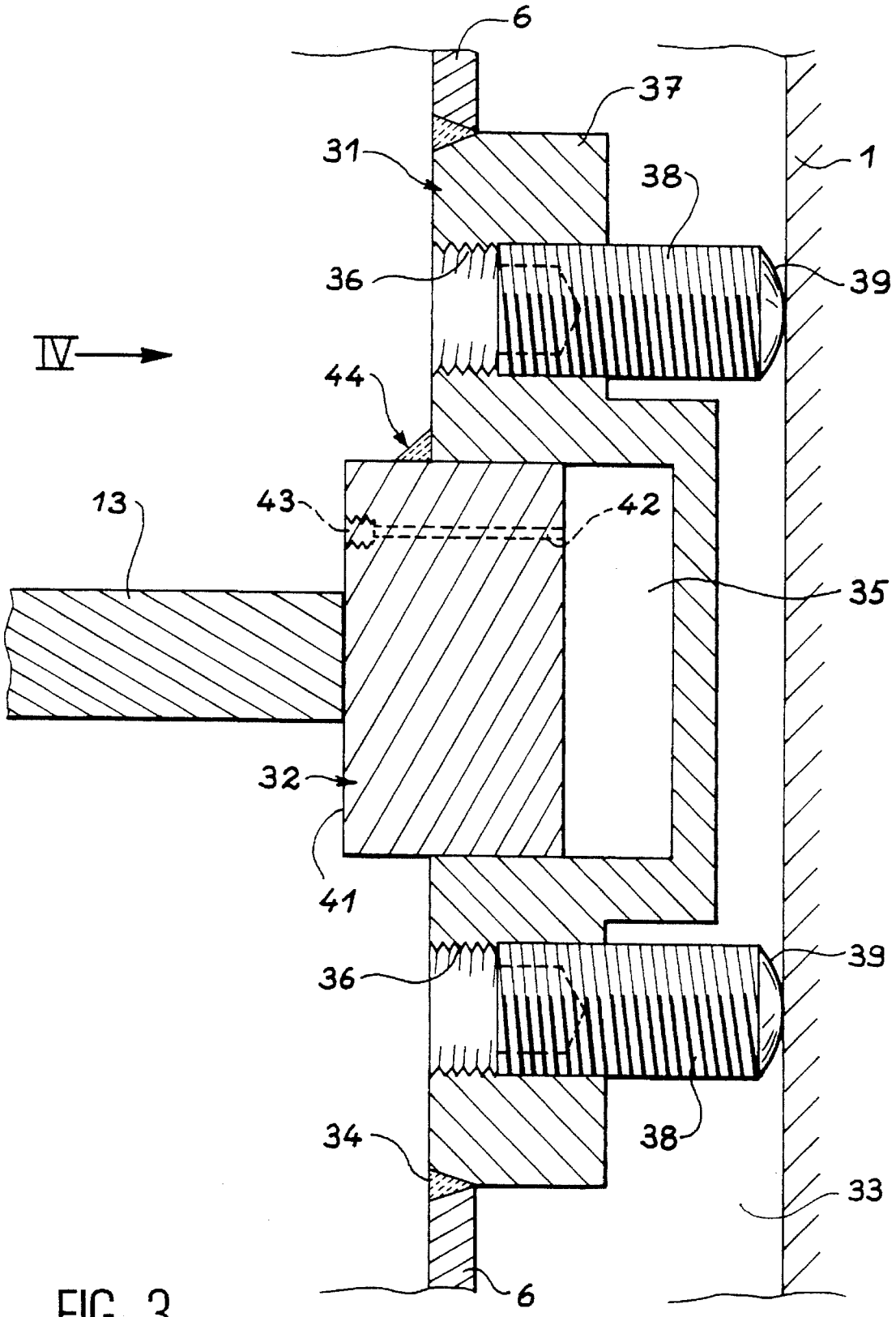
FIG. 3 is a section view along line III—III of FIG. 4, showing a radial holding abutment according to the invention in a view generally similar to FIG. 2.
Figure 4:
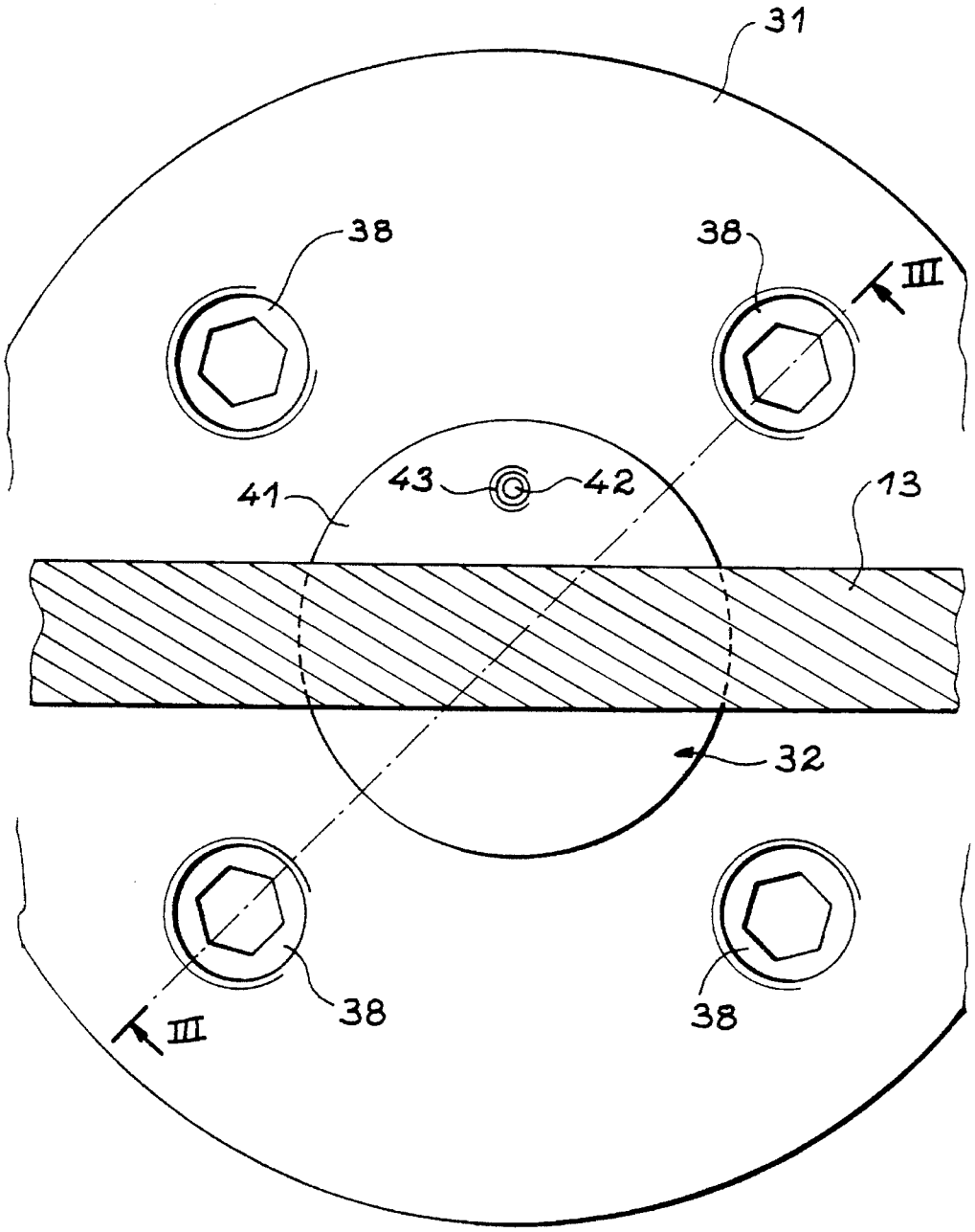
FIG. 4 a view of the radial holding abutment in accordance with arrow IV in FIG. 3.

FIGS. 3 and 4 illustrate a first embodiment. A first circular part 31 is fixed by a weld bead 34 to an axial, circular opening made in the bundle envelope 6 level with a spacer plate 13. This part occupies a portion of the annular space 33 separating the two envelopes. The first part 31 of each abutment is welded to the bundle envelope prior to the installation operations of the steam generator.

In its center the first part 31 has a circular cavity 35 on the inside of the steam generator. The peripheral portion of the part 31, which is shaped like a ring 37, has four tapped holes 36 regularly arranged around the ring. Into tapped holes 36 are screwed four screws 38 for regulating the position of the bundle envelope 6 with respect to the pressure envelope 1. Contact between the pressure envelope and each end of the screws 38 takes place along a cambered face 39.

The cylindrical second part 32 serves as a piston in the cavity 35 of the first part 31 and is intended to bear by its rear face 41 on the spacer plate 13.

A duct 42 completely traverses the part 32 connecting the rear face 41 of said part to the cavity 35. The duct 42 communicates with the rear face 41 by an orifice 43 able to receive a compressed air supply nozzle.

On installation, the bundle envelope 6 is put into position in the pressure envelope 1 respecting the necessary spacing between the two envelopes by means of feeler gauges through a hole provided for this purpose in the bundle envelope. The screws 38, which may be hexagonal hollow screws, are then adjusted by an Allen spanner in order to obtain the necessary contact with the inner wall of the pressure envelope. They can then be locked by a weld spot made between each of the screws 38 and the first part 31.

The piston 32 is then introduced into the cavity 35 and brought into contact with the correctly positioned spacer plate 13 by inflation. Inflation can take place with compressed air under a pressure of 7 bars. The position obtained is then fixed with the aid of a weld bead 44 linking the parts 31 and 32.

Figure 5:
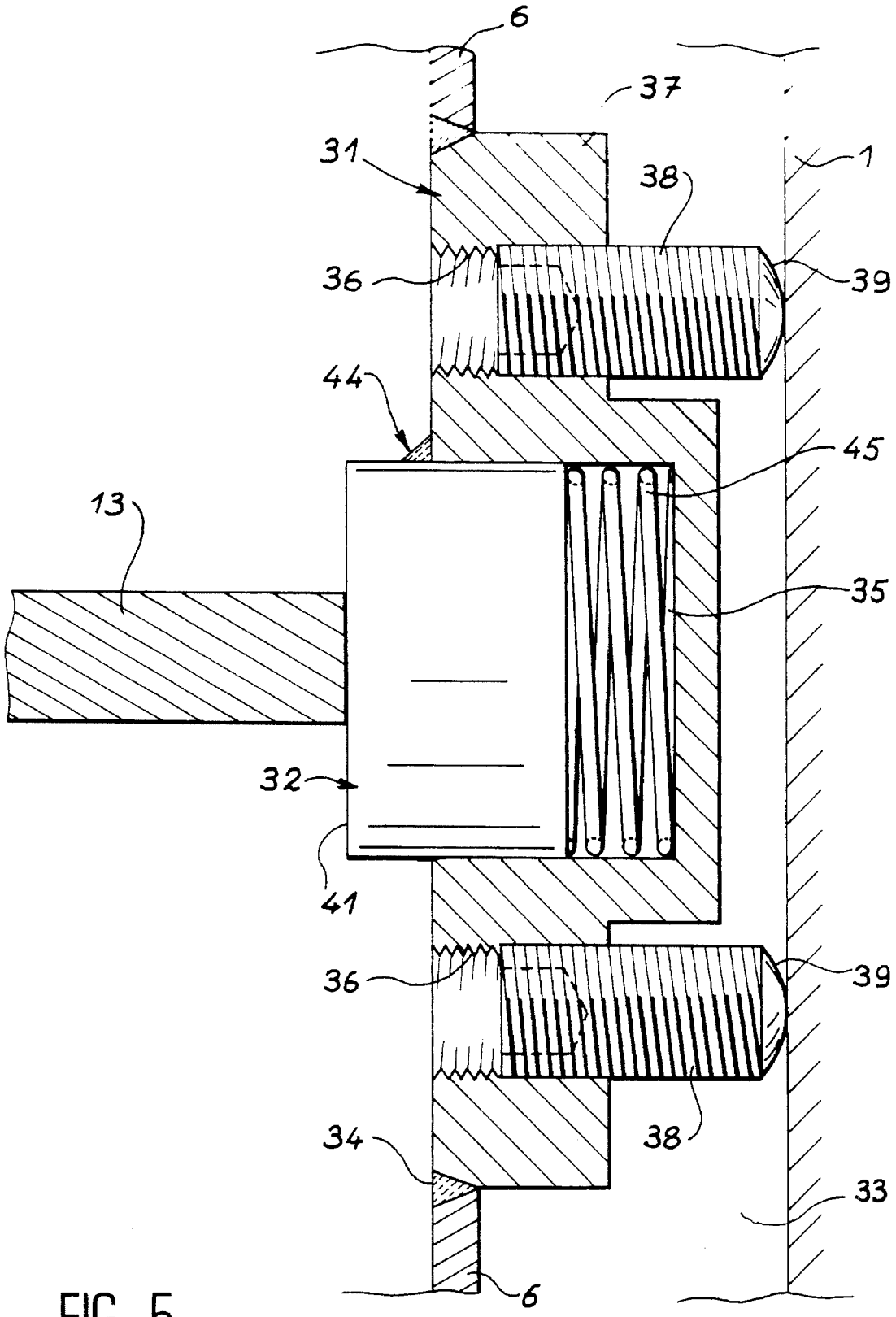
FIG. 5 a variant of the radial holding abutment according to the invention.

FIG. 5 illustrates a second variant. The elastic pressure for bringing the part 32 into contact with the spacer plate 13 is in this case obtained by a spiral spring 45 located in the cavity 35.

In both these variants it is possible to ensure a large bearing surface contact between the edge of the spacer plate 13 and the rear face 41 of the part 32.

I claim:

1. Device for radially holding an envelope of a tube bundle and spacer plates of a steam generator, said steam generator comprising a pressure envelope extending along a given axis, an envelope of said tube bundle extending along a same axis and being contained in said pressure envelope so as to leave an annular space between the two envelopes, said spacer plates being located at given intervals and transversely to said axis within said envelope of said tube bundle in order to support tubes of said bundle, said holding device being constituted by abutments traversing a wall of said envelope of said tube bundle and fixed to said wall level with said spacer plates, said abutments being distributed on a periphery of each said spacer plate in order to radially separate said envelope of said tube bundle from said pressure envelope and so as to exert rigid holding stresses between said spacer plates and said envelope of said tube bundle, each abutment having a first part fixed to said envelope of said tube bundle and incorporating means permitting optional sliding of said abutments on the inner face of said pressure envelope according to said axis and means for varying their radial dimension with respect to said axis, each abutment also having a second part with means for exerting said rigid holding stress on said spacer plate, fixing means being provided for immobilizing said second part with respect to said envelope of said tube bundle after contacting said second part and said spacer plate, wherein said second part is connected to said first part by elastic means so as to make it movable with respect to said first part in a radial direction relative to said axis between a first position corresponding to a first minimum radial dimension of said abutment and a second position corresponding to contact with said spacer plate.

2. Device according to claim 1, wherein said first part has a cavity housing said second part forming a piston in said cavity.

3. Device according to claim 2, wherein said elastic means comprise a fluid blown into the cavity, in the space located between said first part and said second part.

4. Device according to claim 3, wherein said fluid is blown in by a duct traversing said second part.

5. Device according to claim 1 or 2, wherein said elastic means comprises a spring positioned between said first part and said second part.

6. Device according to claim 1 or 2, wherein said means permitting optional sliding and the means for varying radial dimension are constituted by at least one screw screwed into said first part, contact between said screw and said inner face of said pressure envelope taking place along a cambered end of said screw.

7. Device according to claim 1 or 2, wherein said fixing means are constituted by a weld between said first part and said second part.

8. Device according to claim 1 or 2, wherein contact between said second part and said spacer plate takes place along a large bearing surface of said second part exerting pressure on an edge of said spacer plate.

* * * * *